US006945543B2

(12) United States Patent
De Bortoli et al.

(10) Patent No.: US 6,945,543 B2
(45) Date of Patent: Sep. 20, 2005

(54) SNOW-BOARD BINDING

(75) Inventors: Giuseppe De Bortoli, Montebelluna (IT); Thomas Delago, Oberammergau (DE)

(73) Assignee: Nitro AG, Steinhausen (CH)

( * ) Notice: Subject to any disclaimer, the term of this patent is extended or adjusted under 35 U.S.C. 154(b) by 129 days.

(21) Appl. No.: 10/451,754

(22) PCT Filed: Dec. 22, 2000

(86) PCT No.: PCT/IT00/00547

§ 371 (c)(1),
(2), (4) Date: Oct. 7, 2003

(87) PCT Pub. No.: WO02/051511

PCT Pub. Date: Jul. 4, 2002

(65) Prior Publication Data

US 2004/0061311 A1 Apr. 1, 2004

(51) Int. Cl.[7] ..... B62M 29/00
(52) U.S. Cl. ..... 280/14.21; 280/619; 36/117.8
(58) Field of Search ..... 280/619, 607, 280/617, 623, 14.22, 14.21, 14.24, 624, 11.36, 621, 622, 627, 633, 634; 36/117.8, 118.9, 118.1

(56) References Cited

U.S. PATENT DOCUMENTS 4,969,278 A * 11/1990 Ottieri ..... 36/117.8
5,556,123 A * 9/1996 Fournier ..... 280/607
5,692,765 A 12/1997 Laughlin
5,791,021 A * 8/1998 James ..... 24/68 SK
5,857,700 A * 1/1999 Ross ..... 280/623
5,927,744 A * 7/1999 Knapschafer ..... 280/619
6,065,770 A * 5/2000 Hansen et al. ..... 280/617
6,267,390 B1 * 7/2001 Maravetz et al. ..... 280/14.21
6,416,075 B1 * 7/2002 Laughlin et al. ..... 280/624
6,709,003 B2 * 3/2004 Laughlin et al. ..... 280/623

FOREIGN PATENT DOCUMENTS

| | | |
|---|---|---|
| EP | 0 475 068 | 3/1992 |
| EP | 1 118 360 | 7/2001 |
| FR | 2 774 302 | 8/1999 |
| WO | WO 98/47578 | 10/1998 |
| WO | WO 00/76603 | 12/2000 |

OTHER PUBLICATIONS

International Search Report Dated Sep. 17, 2001.

* cited by examiner

*Primary Examiner*—Hau Phan
(74) *Attorney, Agent, or Firm*—RatnerPrestia

(57) ABSTRACT

A snow board binding comprises a base for supporting a footwear, at least one strap fastening connected to the base for restraining the footwear on the base, and a connection between the strap fastening and the base. The connection comprises a first portion of the strap fastening having greater flexibility than any remaining portion of the strap fastening.

16 Claims, 3 Drawing Sheets

SNOW-BOARD BINDING

This application is a U.S. national-phase application of International Application No. PCT/IT00/00547.

TECHNICAL FIELD

The present invention relates to a snow-board binding.

TECHNOLOGICAL BACKGROUND

In the technical field referred to, a need has arisen to facilitate the fitting and adjustment of snow board bindings on footwear so that they can be adapted to the snowboarder's various requirements as well as to the existing shapes of foot and footwear.

In most cases, the footwear is held on the base of the binding by two or more strap fastenings, each formed by two straps which can be closed onto one another by a fastening device for varying the extent to which the straps are tightened onto the user's footwear. Both straps of the strap fastening are made of relatively stiff plastic material to ensure the necessary support and clamping of the footwear during sports activities.

However, owing to the stiffness of the material, the fitting of the binding on the footwear is obstructed by the two straps of the strap fastening which have to be deformed resiliently in order to move them apart for this purpose.

Typical snow board bindings are disclosed in International Patent Publication No. WO 00/76603.

DESCRIPTION OF THE INVENTION

The main object of the invention is to provide a snow board binding including at least one strap fastening which is designed structurally and functionally for more convenient fitting on the footwear and improved adaptability to varied shapes of foot and/or footwear.

A further object of the invention is to optimize the coupling between the footwear and the binding.

Yet another object of the invention is to render the operations necessary to adjust the binding particularly quick and easy.

These objects and others which will become clearer from the following description are achieved by providing a snow-board binding formed in accordance with the following description.

BRIEF DESCRIPTION OF THE DRAWINGS

The characteristics and the advantages of the invention will become clearer from the detailed description of a preferred but not exclusive embodiment thereof, described by way of non-limiting example with reference to the appended drawings in which.

PREFERRED EMBODIMENT OF THE INVENTION

Figure 1:
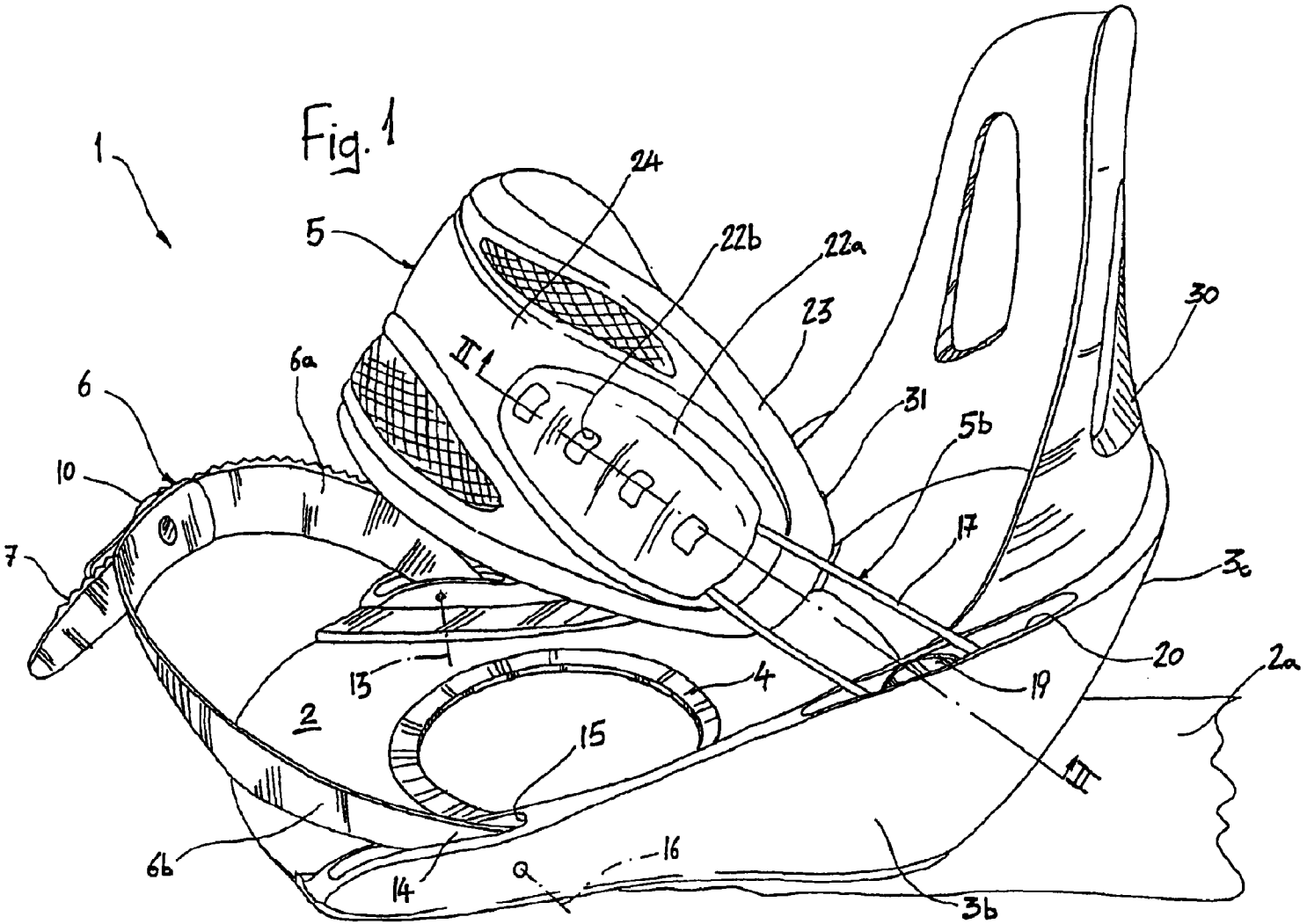
FIG. 1 is a perspective view of a snow board binding according to the invention.
Figure 2:
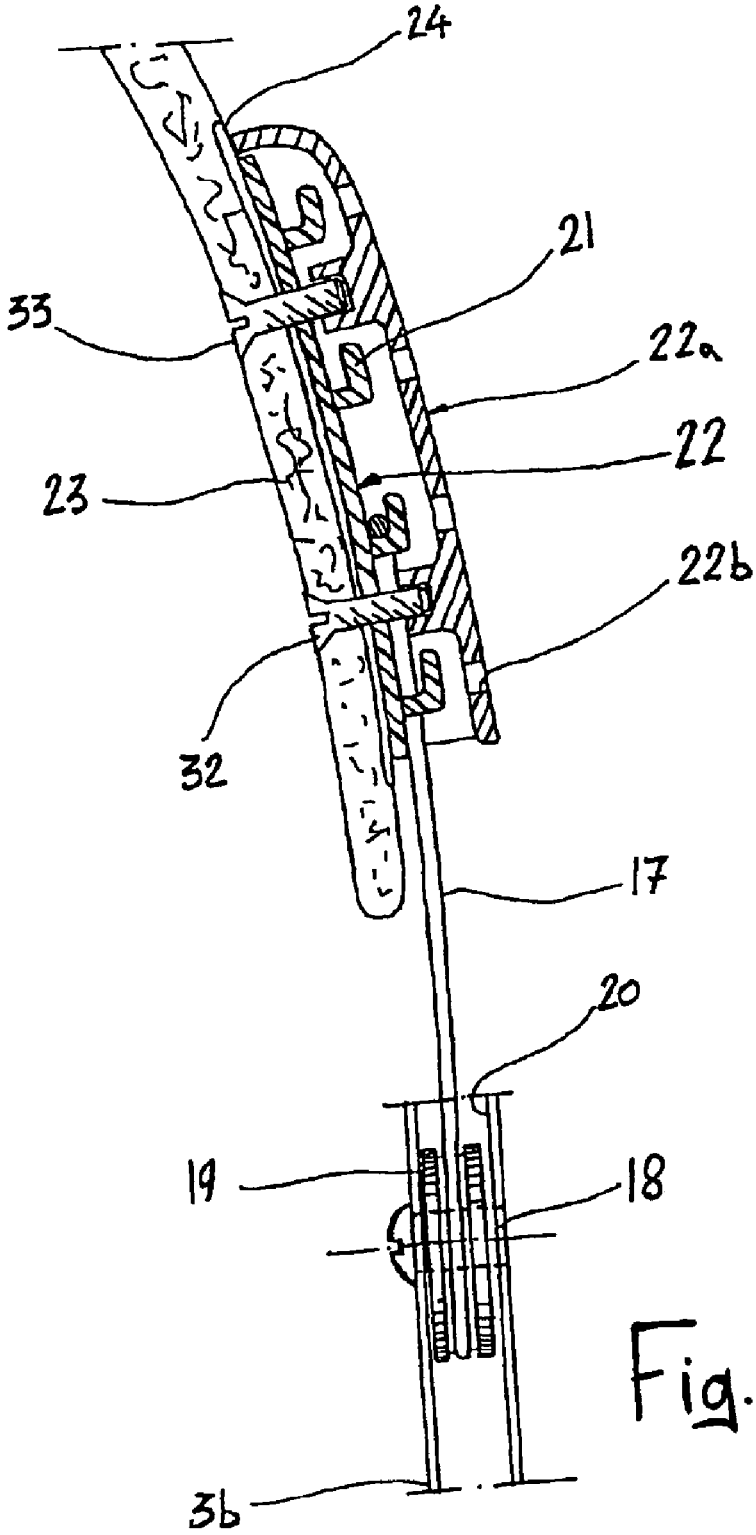
FIG. 2 is a view showing a detail of the binding on an enlarged scale and sectioned on the line II—II of FIG. 1.

With reference to FIG. 1, a snow board binding formed in accordance with the present invention is generally indicated by reference number 1.

The binding 1 comprises a base 2 which can house a snow board shoe or boot (not shown) and is arranged to be fixed to a snow board 2*a* (shown partially) in an angularly adjustable manner by a conventional connection mechanism 4, shown partially.

The base 2 has two facing and opposed side walls 3*a*, 3*b*, which are connected at the rear by a bridge-like support 3*c*, together defining a seat for housing the user's shoe or boot.

The binding 1 further comprises a pair of strap fastenings, that is, a rear strap fastening 5 and a front strap fastening 6, for holding the shoe or boot on the base 2. The rear strap fastening 5 is connected to the base 2 in the manner described below so as to act on the instep and ankle region of the user's foot, and the upper surface of the foot is acted on by the front strap fastening 6.

Each strap fastening 5, 6 comprises two straps 5*a*, 5*b* or 6*a*, 6*b*, respectively, between which a respective adjustable fastening 9, 10 is disposed.

Each of the straps 5*a*, 6*a* comprises a toothed portion 7 and is anchored by one end 11 in a compartment 12 of the respective side wall 3*a* so as to be pivotable about an axis 13.

The strap 6*b* is anchored by one of its ends 14 in a compartment 15 of the respective side wall 3*b* so as to be pivotable about an axis 16. The strap 6*b* carries, at its free end, the adjustable fastening 10 which is of the type that is arranged for bringing about unidirectional, manually released clamping onto the toothed portion 7 of the strap 6*a*.

The strap 5*b* of the strap fastening 5 comprises a first portion which connects it to the base 2 and which is in the form of a loop 17 of flexible metal cable covered by a sheath of plastic material and closed onto itself around an anchoring pin 18. To prevent extreme angles of wrapping of the metal cable, a pulley 19 is interposed between the loop 17 and the pin 18 and the whole is housed and protected in a compartment 20 of the side wall 3*b*. At the end remote from the pulley 19, the loop 17 is anchored in an adjustable position on teeth 21 of a rack 22.

The rack 22 is protected by a cover 22*a* provided with holes 22*b* through which it is possible to see the underlying teeth 21 and thus to select the point of engagement of the loop 17 for the desired adjustment. The rack 22 is in turn fixed on top of a second portion 23 of the strap 5*b* in the form of an element for distributing the clamping load of the rear strap fastening 5 over the user's instep. The rack 22 is fixed by two screws 32, 33 which also have the function of anchoring the cover 22*a* on the rack 22. The second portion 23 is widened and padded and is also equipped with a fairly stiff covering band 24 of plastic material on which the adjustable fastening 9 is anchored.

Figure 3:
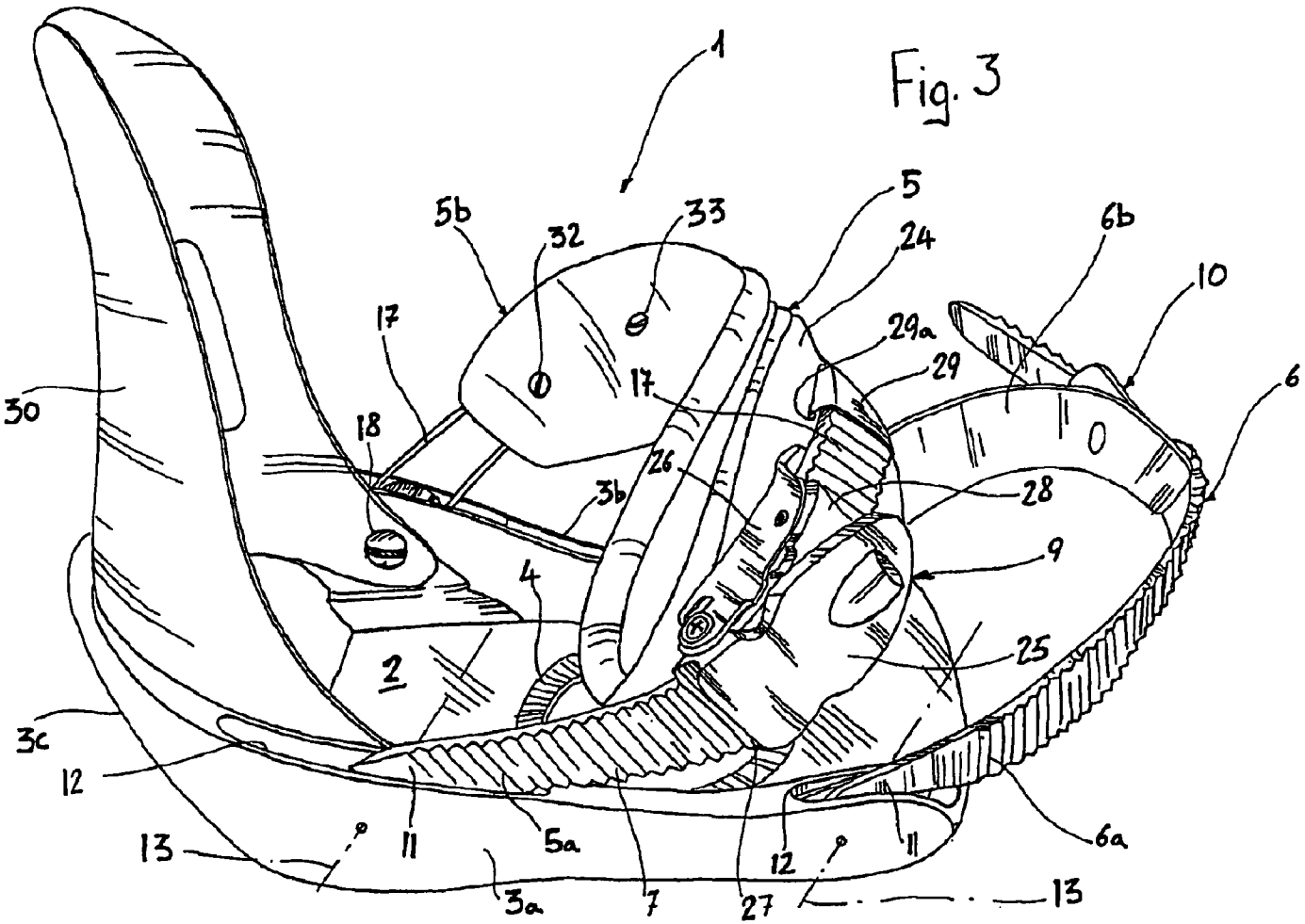
FIG. 3 is a further, partial perspective view of the binding of FIG. 1.

The adjustable fastening 9 is of known type with a lever 25 pivoting on a base 26 and provided with teeth 27 for engaging the toothed portion 7 of the strap 5*a* and pulling it along in the closure direction upon each operative pivoting movement on the base 26. The adjustable fastening 10 also comprises a pawl 28 mounted on the base 26 and acting on the toothed portion 7 in order to restrain the strap 5*a* unidirectionally. It will also be noted that a seat 29 is provided between the covering band 24 and the padded portion of the load-distributing element for the concealed housing of the portion of the strap 5*a* which projects beyond the adjustable fastening 10 as a result of the tightening of the rear strap fastening 5. The opening 29*a* of this seat 29 is visible in FIG. 3.

Finally, the binding 1 is equipped with a rear support 30 connected for pivoting between the side walls 3*a*, 3*b*, for example, on pins 18 and 31.

In operation, during the fitting of the binding 1 on the footwear, the strap 5*a* of the rear strap fastening 5, which is conventionally the stiffer strap owing to the need to incorporate the element for distributing the clamping load of the rear strap fastening 5 over the instep of the user's foot, can easily be opened out, owing to the considerable intrinsic flexibility of the first, metal loop 17 which not only allows the two straps 5*a*, 5*b* of the rear strap fastening 5 to be opened out easily but even allows the strap 5*b* to be left resting on the snow-board in the opened-out condition, enabling the binding 1 to be fitted on the footwear without using one's hands.

Once fitted on the footwear, the binding 1 is tightened thereon by the adjustable fastenings 9 and 10. If necessary, the length of the strap 5*b* can be adjusted beforehand by changing the tooth 21 of the rack 22 on which the loop 17 is engaged.

The front strap fastening 6 may also have a structure similar to that of the rear strap fastening 5 described herein, with the same adjustment capabilities and flexibility. Moreover, the loop 17 may be made of non-metallic materials such as synthetic fibres, plastics materials, etc.

The present invention thus achieves the objects proposed, offering many advantages over the bindings of the prior art.

A first advantage is an extremely quick and easy fitting of the binding on the footwear since the strap fastening can be subjected to twisting or pivoting of any kind in the region of the metal loop without effort on the part of the user so that it does not obstruct the positioning of the footwear on the base of the binding.

Another advantage is that the cable used for the loop has a metal core, since this allows the cable to be very thin, favoring its flexibility but nevertheless ensuring its tensile strength.

Moreover, the binding can be adapted in many ways to varied morphological shapes of foot or to various types of footwear.

Finally, the adjustment both of the overall length of the strap fastening and of its inclination relative to the base of the binding is particularly easy.

What is claimed is:

1. A snow board binding comprising:

a base adapted to support a footwear;

at least one strap fastening connected to the base for restraining the footwear on the base; and a connection between the strap fastening and the base, the connection including a first portion formed by a flexible cable being closed on itself to form a loop and having greater flexibility than the strap fastening, the connection engaging the strap fastening in different positions so that the length of the connection can be adjusted.

2. The binding according to claim 1 wherein the flexible cable has a metal core covered at least partially by a sheath of plastic material.

3. The binding according to claim 1 wherein the strap fastening comprises two straps, one of which carries an element adapted to distribute the clamping load of the strap fastening over the instep of a user's foot, and the flexible cable is connected to the element.

4. The binding according to claim 3 wherein the flexible cable is adjustably anchored to the element.

5. The binding according to claim 4 wherein the element has a rack with teeth and the loop of the flexible cable is adjustably anchored to the element by anchoring the loop selectively on respective teeth of the rack.

6. The binding according to claim 5 wherein each of the teeth is U-shaped and the teeth are spaced apart uniformly.

7. The binding according to claim 5 further comprising a cover for the rack, the cover anchored removably to the rack for protecting the teeth.

8. The binding according to claim 1 wherein the connection further includes a pulley which is connected to the base and around which the loop is closed.

9. The binding according to claim 8 wherein the base has a side wall defining a compartment and the pulley is housed in a concealed manner in the compartment.

10. The binding according to claim 1 further comprising a first strap fastening and a second strap fastening each of which has a connection to the base, each connection including a first portion formed by a flexible cable being closed on itself to form a loop and having greater flexibility than the respective strap fastening, the connections engaging the respective strap fastenings in different positions so that the lengths of the connections can be adjusted.

11. A snow board binding comprising:

a base adapted to support a footwear;

at least one strap fastening connected to the base for restraining the footwear on the base, the strap fastening including two straps;

an element carried by one of the two straps and adapted to distribute the clamping load of the strap fastening over the instep of a user's foot, the element including a rack with teeth; and a connection between the strap fastening and the base, the connection:

(a) including a flexible cable being closed on itself to form a loop and adjustably anchored to the element, by anchoring the loop selectively on respective teeth of the rack, and having greater flexibility than the strap fastening, (b) engaging the strap fastening in different positions so that the length of the connection can be adjusted, and (c) including a pulley which is connected to the base and around which the loop is closed.

12. The binding according to claim 11 wherein the flexible cable has a metal core covered at least partially by a sheath of plastic material.

13. The binding according to claim 11 wherein the base has a side wall defining a compartment and the pulley is housed in a concealed manner in the compartment.

14. The binding according to claim 11 wherein each of the teeth is U-shaped and the teeth are spaced apart uniformly.

15. The binding according to claim 11 further comprising a cover for the rack, the cover anchored removably to the rack for protecting the teeth.

16. A snow board binding comprising:

a base adapted to support a footwear, the base having a side wall defining a compartment;

at least one strap fastening connected to the base for restraining the footwear on the base, the strap fastening including two straps;

an element carried by one of the two straps and adapted to distribute the clamping load of the strap fastening over the instep of a user's foot, the element including a rack with U-shaped teeth spaced apart uniformly;

a cover for the rack, the cover anchored removably to the rack for protecting the teeth; and a connection the strap fastening and the base, the connection:

(a) including a flexible cable formed of a metal core covered at least partially by a sheath of plastic material, the flexible cable being closed on itself to form a loop and adjustably anchored to the element, by anchoring the loop selectively on respective teeth of the rack, and having greater flexibility than the strap fastening, (b) engaging the strap fastening in different positions so that the length of the connection can be adjusted, and (c) including a pulley which is connected to the base and around which the loop is closed, the pulley disposed in a concealed manner in the compartment.

* * * * *